US007207955B2

(12) United States Patent
Krompasick

(10) Patent No.: US 7,207,955 B2
(45) **Date of Patent: *Apr. 24, 2007**

(54) APPARATUS AND METHOD FOR THERAPEUTICALLY TREATING DAMAGED TISSUES, BONE FRACTURES, OSTEOPENIA OR OSTEOPOROSIS

(75) Inventor: Donald E. Krompasick, Bethlehem, PA (US)

(73) Assignee: Juvent, Inc., Somerset, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/448,201

(22) Filed: Jun. 7, 2006

(65) Prior Publication Data

US 2006/0229536 A1 Oct. 12, 2006

Related U.S. Application Data

(63) Continuation of application No. 11/073,978, filed on Mar. 7, 2005, now Pat. No. 7,094,211, which is a continuation of application No. 10/290,839, filed on Nov. 8, 2002, now Pat. No. 6,884,227.

(51) Int. Cl.
*A61H 1/00* (2006.01)

(52) U.S. Cl. ..... 601/90; 601/23; 601/98; 601/100

(58) Field of Classification Search ..... 601/1, 601/23, 24, 26–29, 30–35, 66, 86, 89, 90, 601/97, 98, 100, 101, 104, 105, 107, 108; 5/607, 609, 611
See application file for complete search history.

(56) References Cited

U.S. PATENT DOCUMENTS 2,779,328 A 1/1957 Grossi
3,134,451 A 5/1964 Hanssen
3,193,034 A 7/1965 Hutchinson et al.
3,304,038 A 2/1967 Davis
3,499,437 A 3/1970 Balamuth
3,760,799 A 9/1973 Crowson
3,765,407 A 10/1973 Prince
3,767,195 A 10/1973 Dimick
3,890,953 A 6/1975 Kraus et al.
3,961,380 A 6/1976 Garr
4,105,017 A 8/1978 Ryaby et al.
4,266,532 A 5/1981 Ryaby et al.
4,266,533 A 5/1981 Ryaby et al.

(Continued)

FOREIGN PATENT DOCUMENTS

EP 0 695 559 2/1996
EP 1026484 A1 8/2000

OTHER PUBLICATIONS

"Generation of Electronic Potentials by Bone in Response to Mechanical Stress," Science Magazine, 137, 1063-1064 (Sep. 28, 2002).

*Primary Examiner*—Quang D. Thanh
(74) *Attorney, Agent, or Firm*—Carter DeLuca Farrell & Schmidt, LLP

(57) ABSTRACT

Apparatus and methods for therapeutically treating at least a portion of a body. Apparatus and methods according to various embodiments of the disclosure include a platform for supporting at least a portion of a body. The platform includes at least one plate, a drive lever supported from the plate, and a damping member including a cantilever spring in contact with the drive lever. The platform is actuated at a first frequency. Next, the damping member is oscillated to create a force with a second frequency. Then, the force is distributed to at least a portion of the platform.

21 Claims, 7 Drawing Sheets

U.S. PATENT DOCUMENTS

| | | | |
|---|---|---|---|
| 4,315,503 | A | 2/1982 | Ryaby et al. |
| 4,358,105 | A | 11/1982 | Sweeney, Jr. |
| 4,446,586 | A | 5/1984 | Reed et al. |
| 4,452,326 | A | 6/1984 | Hanssen et al. |
| 4,530,360 | A | 7/1985 | Duarte |
| 4,570,927 | A | 2/1986 | Petrofsky et al. |
| 4,669,483 | A | 6/1987 | Hepp et al. |
| 4,687,195 | A | 8/1987 | Potts |
| 4,710,655 | A | 12/1987 | Masaki |
| 4,782,822 | A | 11/1988 | Ricken |
| 4,787,888 | A | 11/1988 | Fox |
| 4,836,316 | A | 6/1989 | Carnevale et al. |
| 4,858,599 | A | 8/1989 | Halpern |
| 4,905,671 | A | 3/1990 | Senge et al. |
| 4,917,376 | A | 4/1990 | Lo |
| 4,928,959 | A | 5/1990 | Bassett et al. |
| 5,000,442 | A | 3/1991 | Dalebout et al. |
| 5,046,484 | A | 9/1991 | Bassett et al. |
| 5,103,806 | A | 4/1992 | McLeod et al. |
| 5,108,452 | A | 4/1992 | Fallin |
| 5,133,420 | A | 7/1992 | Smith |
| 5,191,880 | A | 3/1993 | McLeod et al. |
| 5,273,028 | A | 12/1993 | McLeod et al. |
| 5,295,931 | A | 3/1994 | Dreibelbis et al. |
| 5,318,561 | A | 6/1994 | McLeod et al. |
| 5,339,804 | A | 8/1994 | Kemp |
| 5,351,389 | A | 10/1994 | Erickson et al. |
| 5,368,044 | A | 11/1994 | Cain et al. |
| 5,376,065 | A | 12/1994 | McLeod et al. |
| 5,380,269 | A | 1/1995 | Urso |
| 5,409,446 | A | 4/1995 | Rattner |
| RE34,959 | E | 5/1995 | Potts |
| 5,431,612 | A | 7/1995 | Holden et al. |
| 5,466,215 | A | 11/1995 | Lair et al. |
| 5,468,220 | A | 11/1995 | Sucher |
| 5,478,306 | A | 12/1995 | Stoner |
| 5,484,388 | A | 1/1996 | Basset et al. |
| 5,492,525 | A | 2/1996 | Gibney |
| 5,496,256 | A | 3/1996 | Bock et al. |
| 5,501,657 | A | 3/1996 | Feero |
| 5,520,612 | A | 5/1996 | Winder et al. |
| 5,556,372 | A | 9/1996 | Talish et al. |
| 5,578,060 | A | 11/1996 | Pohl et al. |
| 5,626,554 | A | 5/1997 | Ryaby et al. |
| 5,702,353 | A | 12/1997 | Guzzini et al. |
| 5,708,236 | A | 1/1998 | Shaanan et al. |
| 5,721,400 | A | 2/1998 | Haraldsson et al. |
| 5,741,317 | A | 4/1998 | Ostrow |
| 5,755,746 | A | 5/1998 | Lifshey et al. |
| 5,762,616 | A | 6/1998 | Talish |
| 5,779,600 | A | 7/1998 | Pape |
| 5,868,649 | A | 2/1999 | Erickson et al. |
| 5,871,446 | A | 2/1999 | Wilk |
| 5,886,302 | A | 3/1999 | Germanton et al. |
| 5,957,814 | A | 9/1999 | Eschenbach |
| 5,997,490 | A | 12/1999 | McLeod et al. |
| 6,019,710 | A | 2/2000 | Dalebout et al. |
| 6,022,349 | A | 2/2000 | McLeod et al. |
| 6,061,597 | A | 5/2000 | Rieman et al. |
| 6,068,596 | A | 5/2000 | Weth et al. |
| 6,080,088 | A | 6/2000 | Petersen et al. |
| 6,086,078 | A | 7/2000 | Ferez |
| 6,093,135 | A | 7/2000 | Huang |
| 6,106,491 | A | 8/2000 | Gianutsos |
| 6,179,797 | B1 | 1/2001 | Brotz |
| 6,234,975 | B1 | 5/2001 | McLeod et al. |
| 6,258,020 | B1 | 7/2001 | Lopez |
| 6,656,137 | B1 | 12/2003 | Tyldsley et al. |
| 6,843,776 | B2 | 1/2005 | Trandafir et al. |
| 6,884,227 | B2 * | 4/2005 | Krompasick ..... 601/90 |
| 7,094,211 | B2 * | 8/2006 | Krompasick ..... 601/90 |

* cited by examiner

APPARATUS AND METHOD FOR THERAPEUTICALLY TREATING DAMAGED TISSUES, BONE FRACTURES, OSTEOPENIA OR OSTEOPOROSIS

CROSS-REFERENCE TO RELATED APPLICATIONS

This patent application is a continuation of U.S. patent application Ser. No. 11/073,978 filed on Mar. 7, 2005, now U.S. Pat. No. 7,094,211, which is a continuation of U.S. patent application Ser. No. 10/290,839, filed on Nov. 8, 2002, now U.S. Pat. No. 6,884,227. The priority of these prior patents is expressly claimed and the entire contents of these disclosures are hereby incorporated by reference herein.

BACKGROUND OF THE INVENTION

1. Field of the Invention

The invention generally relates to the field of stimulating tissue growth and healing, and more particularly to apparatuses and methods for therapeutically treating damaged tissues, bone fractures, osteopenia, osteoporosis, or other tissue conditions.

2. Description of Related Art

When damaged, tissues in a human body such as connective tissues, ligaments, bones, etc. all require time to heal. Some tissues, such as a bone fracture in a human body, require relatively longer periods of time to heal. Typically, a fractured bone must be set and then the bone can be stabilized within a cast, splint or similar type of device. This type of treatment allows the natural healing process to begin. However, the healing process for a bone fracture in the human body may take several weeks and may vary depending upon the location of the bone fracture, the age of the patient, the overall general health of the patient, and other factors that are patient-dependent. Depending upon the location of the fracture, the area of the bone fracture or even the patient may have to be immobilized to encourage complete healing of the bone fracture. Immobilization of the patient and/or bone fracture may decrease the number of physical activities the patient is able to perform, which may have other adverse health consequences.

Osteopenia, which is a loss of bone mass, can arise from a decrease in muscle activity, which may occur as the result of a bone fracture, bed rest, fracture immobilization, joint reconstruction, arthritis, and the like. However, this effect can be slowed, stopped, and even reversed by reproducing some of the effects of muscle use on the bone. This typically involves some application or simulation of the effects of mechanical stress on the bone.

Promoting bone growth is also important in treating bone fractures, and in the successful implantation of medical prostheses, such as those commonly known as "artificial" hips, knees, vertebral discs, and the like, where it is desired to promote bony ingrowth into the surface of the prosthesis to stabilize and secure it.

Numerous different techniques have been developed to reduce the loss of bone mass. For example, it has been proposed to treat bone fractures by application of electrical voltage or current signals (e.g., U.S. Pat. Nos. 4,105,017; 4,266,532; 4,266,533, or 4,315,503). It has also been proposed to apply magnetic fields to stimulate healing of bone fractures (e.g., U.S. Pat. No. 3,890,953). Application of ultrasound to promoting tissue growth has also been disclosed (e.g., U.S. Pat. No. 4,530,360).

While many suggested techniques for applying or simulating mechanical loads on bone to promote growth involve the use of low frequency, high magnitude loads to the bone, this has been found to be unnecessary, and possibly also detrimental to bone maintenance. For instance, high impact loading, which is sometimes suggested to achieve a desired high peak strain, can result in fracture, defeating the purpose of the treatment.

It is also known in the art that low level, high frequency stress can be applied to the bone, and that this will result in advantageous promotion of bone growth. One technique for achieving this type of stress is disclosed, e.g., in U.S. Pat. Nos. 5,103,806; 5,191,880; 5,273,028; 5,376,065; 5,997,490, and 6,234,975, the entire contents of each of which are incorporated herein by reference. In this technique, the patient is supported by a platform that can be actuated to oscillate vertically, so that the oscillation of the platform, together with acceleration brought about by the body weight of the patient, provides stress levels in a frequency range sufficient to prevent or reduce bone loss and enhance new bone formation. The peak-to-peak vertical displacement of the platform oscillation may be as little as 2 mm.

However, these systems and associated methods often depend on an arrangement of multiple springs supporting the platform, with the result that precise positioning of the patient on the platform becomes important. Moreover, even a properly positioned patient standing naturally will exert more force on some portions of the platform than others, with the result that obtaining true vertical motion of the patient becomes difficult or impossible.

There remains a need in the art for an oscillating platform apparatus that is highly stable, and relatively insensitive to positioning of the patient on the platform, while providing low displacement, high frequency mechanical loading of bone tissue sufficient to promote healing and/or growth of damaged tissues, bone tissue, reduce or prevent osteopenia or osteoporosis, or other tissue conditions.

Furthermore, there remains a need for apparatuses and methods for therapeutically treating damaged tissues, bone fractures, osteopenia, osteoporosis, or other tissue conditions.

SUMMARY OF THE INVENTION

The invention described herein satisfies the needs described above. More particularly, apparatuses and methods according to various embodiments of the invention are for therapeutically treating damaged tissues, bone fractures, osteopenia, osteoporosis, or other tissue conditions. Furthermore, apparatuses and methods according to various embodiments of the invention can be an oscillating platform apparatus that is highly stable and relatively insensitive to positioning of the patient on the platform, while providing low displacement, nigh frequency mechanical loading of bone, muscle, tissue, etc. sufficient to promote healing and/or growth of bone tissue, or reduce, reverse, or prevent osteopenia or osteoportosis, or other tissue conditions. Note that a platform according to the invention can be referred to as an "oscillating platform" or as a "mechanical stress platform."

One aspect of apparatuses and methods according to various embodiments of the invention focuses on a platform for therapeutically treating bone fractures, osteopenia, osteoporosis, or other tissue conditions. The platform supports a body. The platform includes an upper plate; a lower plate; a drive lever supported from the lower plate; a spring in contact with the drive lever; and a distributing lever arm in contact with the upper plate. The drive lever is actuated at a first predetermined frequency. Next, the damping member creates an oscillating force at a second predetermined frequency on the drive lever. A portion of the oscillating force transfers to the distributing lever arm. Then a portion of the oscillating force from the distributing lever arm transfers to the platform so that the body on the platform receives an oscillation.

A particular method for therapeutically treating a tissue in a body having a mass includes supporting a body with a platform. The method includes actuating the platform at a first frequency, and then oscillating the platform to create an oscillating force with a second frequency associated with a resonance frequency of the mass of the body. Finally, the method includes distributing the oscillating force to the mass of the body on the platform.

Another particular method for therapeutically treating tissue in a body includes supporting a body with a mass on a platform. The platform includes an upper plate; a lower plate; a drive lever supported by the lower plate; a damping member in contact with the drive lever; and a distributing lever arm in contact with the upper plate. The method also includes actuating the drive lever at a first predetermined frequency; oscillating the damping member to create an oscillating force with a second predetermined frequency; transferring a portion of the oscillating force from the damping member to the distributing lever arm; and distributing a portion of the oscillating force from the distributing lever arm to the platform so that the body's mass on the platform receives an oscillation.

Objects, features and advantages of various apparatuses and methods according to various embodiments of the invention include:

(1) providing the ability to therapeutically treat damaged tissues, bone fractures, osteopenia, osteoporosis, or other tissue conditions in a body;

(2) providing the ability to therapeutically treat tissues in a body to reduce or prevent osteopenia or osteoporosis;

(3) providing the ability to therapeutically treat damaged tissues, bone fractures, osteopenia, osteoporosis, or other tissue conditions in a body at a frequency effective to promote tissue or bone healing, growth, and or regeneration; and (4) providing an apparatus adapted to therapeutically treat damaged tissues, bone fractures, osteopenia, osteoporosis, or other tissue conditions in a body.

Other objects, features and advantages of various aspects and embodiments of apparatuses and methods according to the invention are apparent from the other parts of this document.

DETAILED DESCRIPTION OF SPECIFIC EMBODIMENTS

Apparatuses and methods in accordance with various embodiments of the invention are for therapeutically treating tissue damage, bone fractures, osteopenia, osteoporosis, or other tissue conditions. Furthermore, apparatuses and methods in accordance with various embodiments of the invention provide an oscillating platform apparatus that is highly stable, and relatively insensitive to positioning of the patient on the platform, while providing low displacement, high frequency mechanical loading of bone tissue sufficient to promote healing and/or growth of tissue damage, bone tissue, or reduce, reverse, or prevent osteopenia and osteoporosis, and other tissue conditions.

Figure 1:
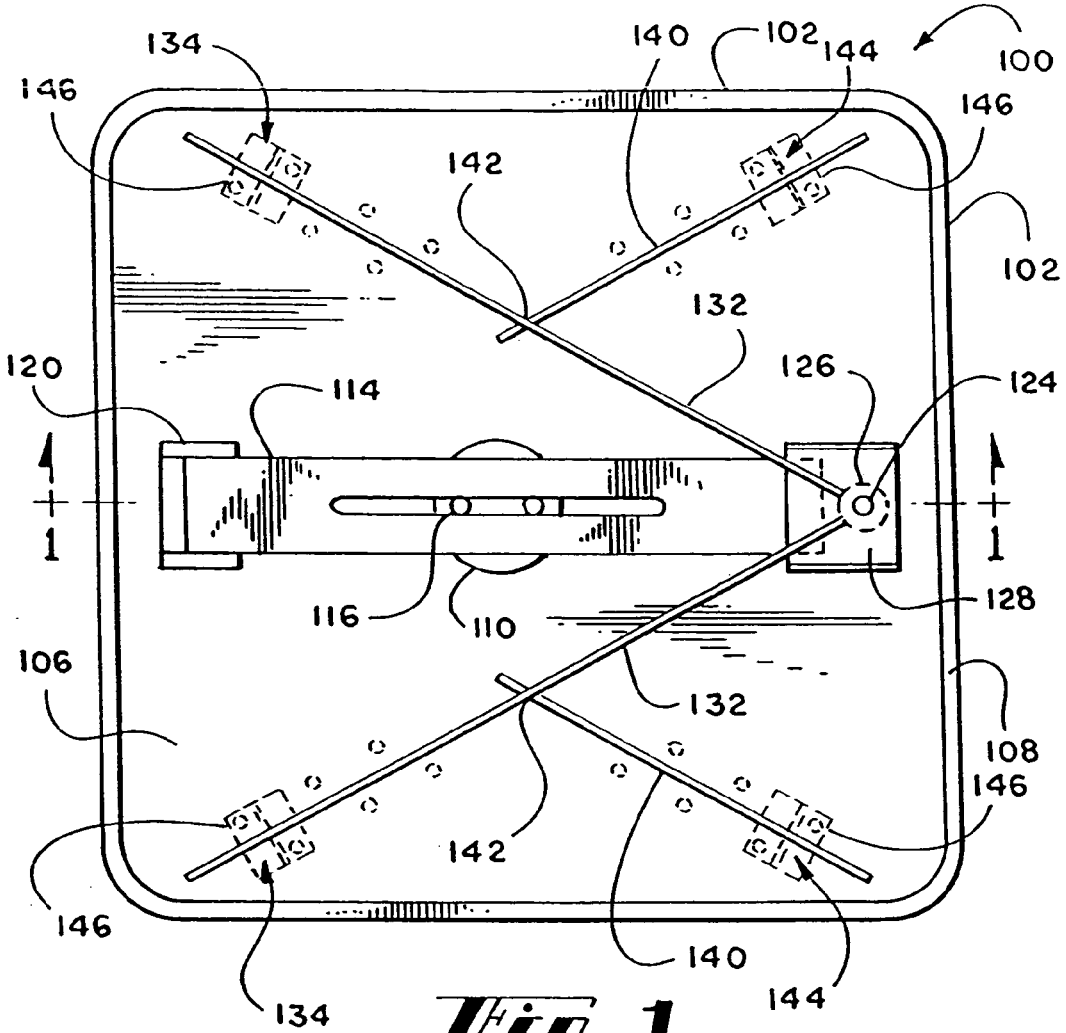
FIG. 1 is a top plan view of an oscillating platform according to various embodiments of the invention, viewed through the top plate, and showing the internal mechanism of the platform.
Figure 2:
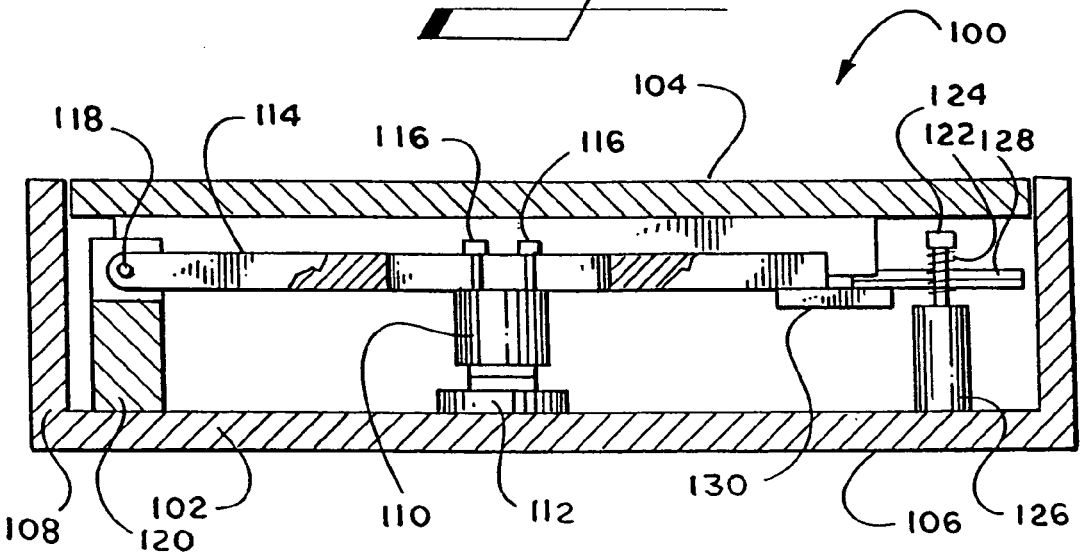
FIG. 2 is a side sectional view taken along line 1—1 in FIG. 1, and partially cut away to show details of the connection of the oscillating actuator to the drive lever.
Figure 3:
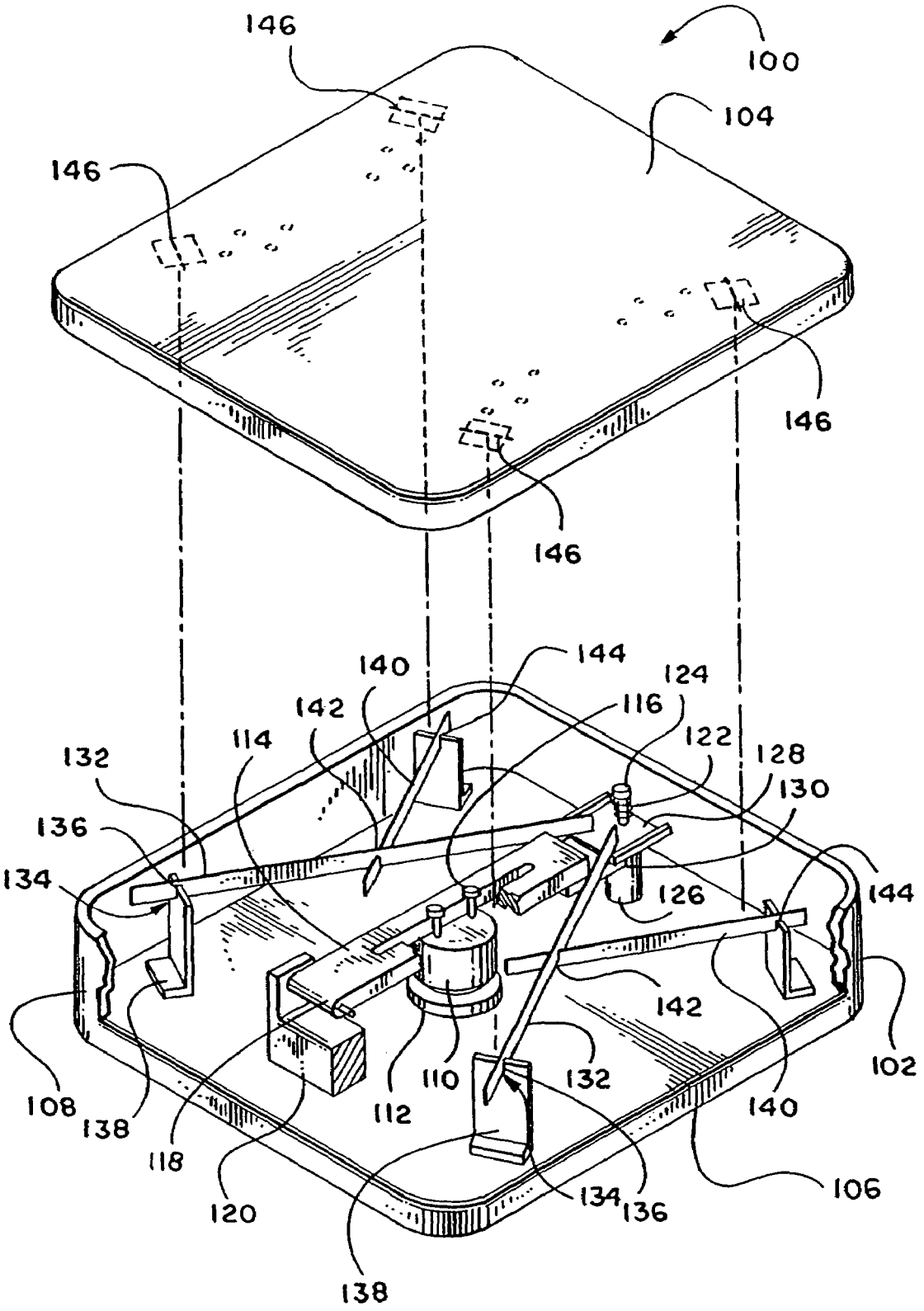
FIG. 3 is an exploded perspective view of the oscillating platform shown in FIG. 1, and partially cut away to show the internal mechanism of the platform.

FIGS. 1–3 illustrate an oscillating platform according to various embodiments of the invention. FIG. 1 shows a top plan view of the platform 100, which is housed within a housing 102. The platform 100 can also be referred to as an oscillating platform or a mechanical stress platform. The housing 102 includes an upper plate 104 (best seen in FIGS. 2 and 3), lower plate 106, and side walls 108. Note that the upper plate 104 is generally rectangular or square-shaped, but can otherwise be geometrically configured for supporting a body in an upright position on top of the upper plate 104, or in a position otherwise relative to the platform 100. Other configurations or structures can be also used to support a body in an upright position above, or otherwise relative to the platform. FIG. 1 shows the platform 100 through top plate 104, so that the internal mechanism can be illustrated. Oscillating actuator 110 mounts to lower plate 106 by oscillator mounting plate 112, and connects to drive lever 114 by one or more connectors 116.

Oscillating actuator 110 causes drive lever 114 to rotate a fixed distance around drive lever pivot point 118 on drive lever mounting block 120. The oscillating actuator 110 actuates the drive lever at a first predetermined frequency. The motion of the drive lever 114 around the drive lever pivot point 118 is damped by a damping member such as a spring 122, best seen in FIGS. 2 and 3. The damping member or spring 122 creates an oscillation force at a second predetermined frequency. One end of spring 122 is connected to spring mounting post 124, which is supported by mounting block 126, while the other end of spring 122 is connected to distributing lever support platform 128. Distributing lever support platform 128 is connected to drive lever 114 by connecting plate 130. Distributing lever support platform 128 supports primary distributing levers 132, which rotate about primary distributing lever pivot points 134, which may be formed by the surface of the primary distributing lever 132 bearing against the end of a notch 136 in a support 138 extending from lower plate 106. Secondary distributing levers 140 are connected to primary distributing levers 132 by linkages 142, which may be simply mutually engaging slots. Secondary distributing levers 132 rotate about pivot points 144 in a manner similar to that described above for the primary distributing levers 132.

Upper plate 104 is supported by a plurality of contact points 146, which can be adjustably secured to the underside of the upper plate 104, and which contact the upper surfaces of primary distributing levers 132, secondary distributing levers 140, or some combination thereof.

In operation, a patient (not shown) sits or stands on the upper plate 104, which is in turn supported by a combination of the primary distributing levers 132 and secondary distributing levers 140. When the apparatus is operating, oscillating actuator 110 moves up and down in a reciprocal motion, causing drive lever 114 to oscillate about its pivot point 118 at a first predetermined frequency. The rigid connection between the drive lever 114 and distributing lever support platform 128 results in this oscillation being damped by the force created or exerted by the spring 122, which can desirably be driven at a second predetermined frequency, in some embodiments its resonance frequency and/or harmonic or sub-harmonics of the resonance frequency. The oscillatory displacement is transmitted from the distributing lever support platform 128 to primary distributing levers 132 and thus to secondary distributing levers 140. One or more of the primary distributing levers 132 and/or secondary distributing levers 140 distribute the motion imparted by the oscillation to the free-floating upper plate 104 by virtue of contact points 146. The oscillatory displacement is then transmitted to the patient supported by the upper plate 104, thereby imparting high frequency, low displacement mechanical loads to the patient's tissues, such as the bone structure of the patient supported by the platform 100.

In this particular embodiment, the oscillating actuator 110 can be a piezoelectric or electromagnetic transducer configured to generate a vibration. Other conventional types of transducers may be suitable for use with the invention. For example, if small ranges of displacements are contemplated, e.g. approximately 0.002 inches (0.05 mm) or less, then a piezoelectric transducer, a motor with a cam, or a hydraulic-driven cylinder can be employed. Alternatively, if relatively larger ranges of displacements are contemplated, then an electromagnetic transducer can be employed. Suitable electromagnetic transducers, such as a cylindrically configured moving coil high performance linear actuator may be obtained from BEI Motion Systems Company, Kimchee Magnetic Division of San Marcos, Calif. Such a electromagnetic transducer may deliver a linear force, without hysteresis, for coil excitation in the range of 10–100 Hz, and short-stroke action in ranges as low as 0.8 inches (2 mm) or less.

Furthermore, the spring 122 can be a conventional type spring configured to resonate at a predetermined frequency, or resonance frequency. The resonance frequency of the spring can be determined from the equation:

$$\text{Resonance Frequency(Hz)}=[\text{Spring Constant}(k)/\text{Mass (lbs)}]^{1/2}$$

For example, if the oscillating platform is to be designed for treatment of humans, the spring 122 can be sized to resonate at a frequency between approximately 30–36 Hz. If the oscillating platform is to be designed for the treatment of animals, the spring 122 can be sized to resonate at a frequency up to 120 Hz. An oscillating platform configured to oscillate at approximately 30–36 Hz utilizes a compression spring with a spring constant (k) of approximately 9 pounds (lbs.) per inch in the embodiment shown. In other configurations of an oscillating platform, oscillations of a similar range and frequency can be generated by one or more springs, or by other devices or mechanisms designed to create or otherwise dampen an oscillation force to a desired range or frequency.

FIG. 2 is a side sectional view taken along line 1–1 in FIG. 1, and partially cut away to show details of the connection of the oscillating actuator 110 to the drive lever 114. The drive lever 114 includes an elongate slot 148 (also shown in FIGS. 1 and 3) for receiving connectors 116. The elongate slot 148 permits the oscillating actuator 110 to be selectively positioned along a portion of the length of the drive lever 114. The connectors 116 can be manually adjusted to position the oscillating actuator with respect to the drive lever 114, and then readjusted when a desired position for the oscillating actuator 110 is selected along the length of the elongate slot 148. By adjusting the position of the oscillating actuator 110, the vertical movement or displacement of the drive lever 114 can be adjusted. For example, if the oscillating actuator 110 is positioned towards the drive lever pivot point 118, then the vertical movement or displacement of the drive lever 114 at the opposing end near the spring 122 will be relatively greater than when the oscillating actuator 110 is positioned towards the spring. Conversely, as the oscillating actuator 110 is positioned towards the spring 122, the vertical movement or displacement of the drive lever 114 at the opposing end near the spring 122 will be relatively less than when the oscillating actuator 110 is positioned towards the drive lever pivot point 118.

FIG. 3 is an exploded perspective view of the oscillating platform 100 shown in FIG. 1, and partially cut away to show the internal mechanism of the platform 100. In this embodiment as well as other embodiments, the invention is contained within a housing 102. The housing 102 can be made from any material sufficiently strong for the purposes described herein, e.g. any material that can bear the weight of a patient on the upper plate. For example, suitable materials can be metals, e.g. steel, aluminum, iron, etc.; plastics, e.g. polycarbonates, polyvinylchloride, acrylics, polyolefins, etc.; or composites; or combinations of any of these materials.

Also shown in this embodiment is a series of holes 150 machined through the upper plate 104 of the platform 100. The holes 150 are arranged parallel with each of the primary distributing levers 132 and secondary distributing levers 140. These holes 150 (also shown in FIG. 1) provide different points of connection or attachment for contact points 146, thereby varying the points at which these contact points contact the distributing levers 132, 140, and thus the amount of lever arm and mechanical advantage used in driving the upper plate 104 to vibrate.

Figure 4:
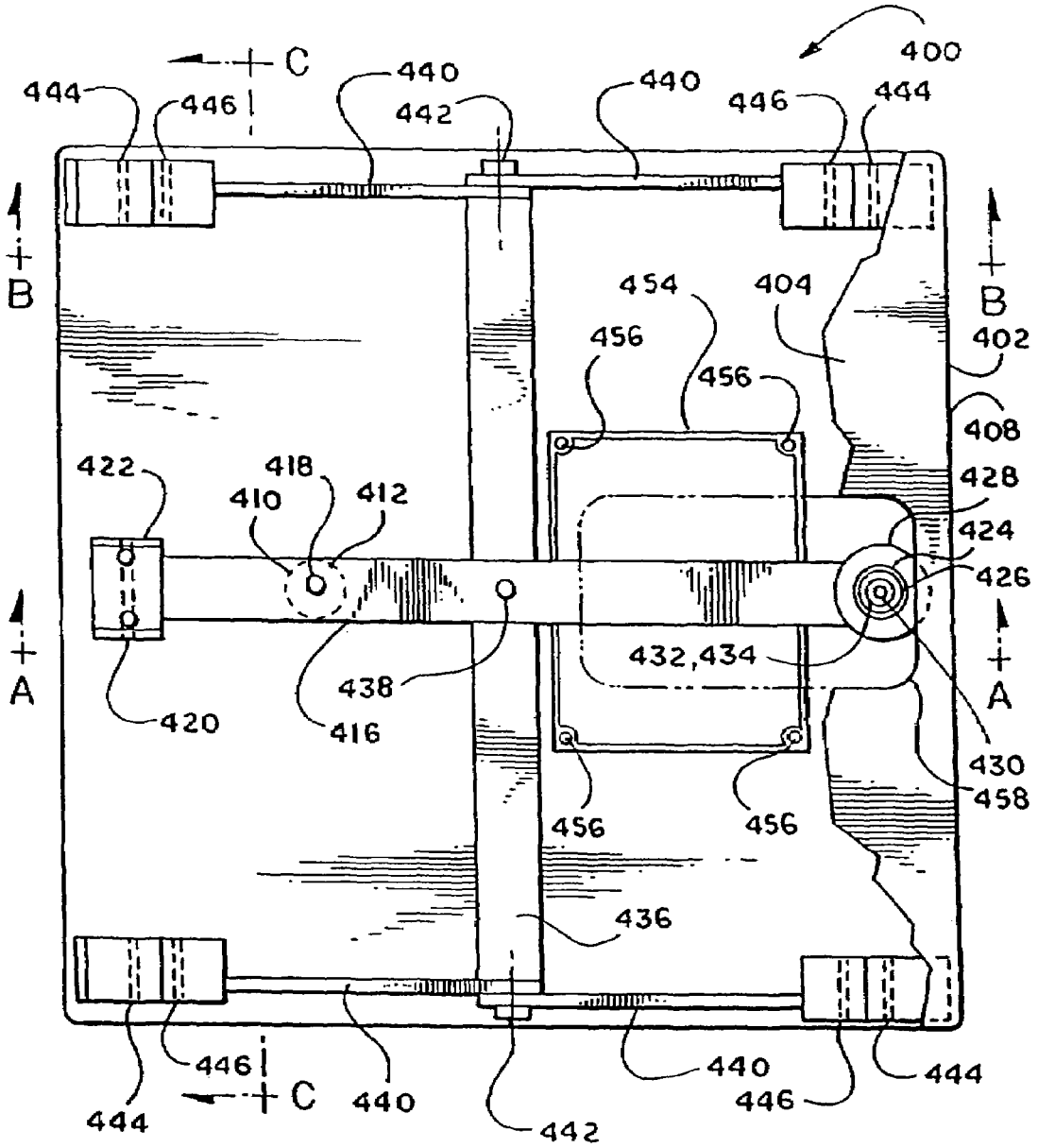
FIG. 4 is a top plan view of another oscillating platform according to various embodiments of the invention, viewed through the top plate, and showing the internal mechanism of the platform.

FIGS. 4–10 illustrate another oscillating platform according to various embodiments of the invention. FIG. 4 shows a top plan view of the platform 400, which is housed within a housing 402. The platform 400 can also be referred to as an "oscillating platform" or a "mechanical stress platform." The housing 402 includes an upper plate 404 (best seen in FIGS. 5–9), lower plate 406, and side walls 408. Note that the upper plate 404 is generally rectangular or square-shaped, but can otherwise be geometrically configured for supporting a body in an upright position on top of the upper plate 404, or in a position otherwise relative to the platform.

Other configurations or structures can be also used to support a body in an upright position above, or otherwise relative to the platform. FIG. 4 shows the platform 400 through upper plate 404, so that the internal mechanism can be illustrated. An oscillating actuator 410 mounts to lower plate 406. The oscillating actuator 410 is an electromagnetic-type actuator that consists of a stationary coil 412 and armature 414. The oscillating actuator 410 is configured so that when the stationary coil 412 is energized, the armature 414 can be actuated relative to the stationary coil 412. The stationary coil 412 mounts to the lower plate 406, while the armature 414 connects to a drive lever 416 by one or more connectors 418.

Oscillating actuator 410 causes drive lever 416 to rotate a fixed distance around drive lever pivot point 420 on drive lever mounting block 422. The oscillating actuator actuates the drive lever 416 at a first predetermined frequency. The drive lever mounting block mounts to the lower plate 406. The motion of the drive lever 416 around the drive lever pivot point 420 is damped by a damping member such as a spring 424, best seen in FIGS. 5–8. The damping member or spring 424 creates an oscillation force at a second predetermined frequency, such as its resonance frequency or a harmonic or sub-harmonic of the resonance frequency. The spring 424 fits around a damping member mounting post such as a spring mounting post 426 which extends between a damping member mounting block such as a spring mounting block 428 and the upper plate 404. The spring mounting post 426 mounts to the lower plate 406.

A hole 430 near one end of the drive lever 416 permits the spring mounting post 426 to extend upward from the spring mounting block 428, through the drive lever 416, and to the bottom side of the top plate 404. One end of the spring 424 is connected to a spring mounting block 428 while the other end of the spring 424 is connected to a lever bearing surface 432 which mounts to the bottom side of the drive lever 416 and around the hole 430 through the drive lever 416. Lever bearing surface 430 is connected to drive lever 416 by a threaded connector 434 that fits within the hole 430. Thus the spring 424 extends between the bottom side of the drive lever 416 and the spring mounting block 428.

A crossover bar 436 mounts to the bottom side of the drive lever 416 with connector 438, and extends in a direction substantially perpendicular to the length of the drive lever 416. At each end of the crossover bar 436, side distributing levers 440 mount to the crossover bar 436 with connectors 442 at one end of each side distributing lever 440. Each side distributing lever 440 then extends substantially perpendicular from the length of the crossover bar 436 and substantially parallel to a respective sidewall 408 of the platform 400. Each side distributing lever 440 rotates about side distributing lever pivot points 444 located near the opposing ends of the side distributing levers 440. A lift pin 446 adjacent to the side distributing lever pivot point 444 and extending substantially perpendicular from the side distributing lever arm 440 bears against the end of a notch 448 in a support 450 extending from upper plate 404.

Upper plate 404 is supported by a plurality of contact points 452 which result from the bearing contact between the upper surface of the lift pin 446 and a portion of the notch 448 in the support 450.

A printed circuit board (PCB) 454 mounts to the lower plate 406 by connectors 456. The PCB 454 provides control circuitry and associated executable commands or instructions for operating the oscillating actuator 410.

An access panel 458 in the upper plate 404 provides maintenance access to the internal mechanism of the platform 400.

In operation, a patient (not shown) sits or stands on the upper plate 404, which is in turn supported by the lift pins 446. When the apparatus is operating, oscillating actuator 410 moves up and down in a reciprocal motion, causing drive lever 416 to oscillate about its pivot point 420 at a first predetermined frequency. The rigid connection between the drive lever 416 and drive lever mounting block 422 results in this oscillation being damped by the force exerted by the spring 424, which can be driven at a second predetermined frequency, in some embodiments its resonance frequency, or a harmonic or sub-harmonic of the resonance frequency. The damped oscillatory displacement is transmitted from the drive lever 416 to crossover bar 436 and thus to side distributing lever arms 440. One or more of the side distributing lever arms 440 distribute the motion imparted by the oscillation to the free-floating upper plate 404 by virtue of the lift pins 446 and contact points 452. The oscillatory displacement is then transmitted to the patient supported by the upper plate 404, thereby imparting high frequency, low displacement mechanical loads to the patient's tissues, such as a bone structure of the patient supported by the platform 400.

It is desired that a high frequency, low displacement mechanical load be imparted to the bone structure of the patient supported by the platform. To achieve this load, in some embodiments the horizontal centerline distance between the damping member or spring 424 and the drive lever pivot point 420 is approximately 12 inches (304.8 mm); and the horizontal centerline distance between the oscillating actuator 410 and the drive lever pivot point 420 is approximately 3 inches (76.2 mm). The ratio of the distance from the damping member or spring 424 to the drive lever pivot point 420, and from the oscillating actuator 410 to the drive lever pivot point 420 may be about 4 to 1, and is also called the drive ratio. Furthermore, in this embodiment, the horizontal centerline distance between the side distributing lever pivot point 444 near the drive lever pivot point 420 and the side distributing lever pivot point 444 near the damping member or spring 424 should be approximately 12 inches (304.8 mm); and the horizontal centerline distance between each side distributing lever pivot point 444 and the respective lift pin may be approximately {fraction (¾)} inch (19 mm). The ratio of the distance from the side distributing lever pivot point 444 near the drive lever pivot point 420 to the side distributing lever pivot point 444 near the spring 424, and from each side distributing lever pivot point 444 and the respective lift pin is about 16 to 1 in some embodiments, and is also called the lifting ratio. In the configuration shown and described, the oscillating platform 400 provides a specific drive ratio and lifting ratio. Other combinations of drive ratios and lifting ratios may be used with varying results in accordance with various embodiments of the invention.

Moreover, in this particular embodiment, the oscillating actuator 410 is an electromagnetic-type actuator configured to actuate or generate a vibration, such as a combination coil and armature or a solenoid. Other conventional types of actuators may be suitable for use with the invention. In the configuration shown and described, the oscillating actuator may be configured to actuate at approximately 30–36 Hz.

Furthermore, the damping member or spring 424 can be a conventional type coil spring configured to resonate in a range of predetermined frequencies. For example, if the oscillating platform is to be designed for treatment of humans, the damping member or spring is sized to resonate at a frequency between approximately 30 and 36 Hz. If the oscillating platform is to be designed for the treatment of vertebrae animals, the damping member or spring is sized to resonate at a frequency range between approximately 30 Hz and 120 Hz. In the configuration shown, the damping member or spring is a compression spring with a spring constant of approximately 9 pounds (lbs.) per inch. In other configurations of an oscillating platform, oscillations of a similar range and frequency can be generated by one or more damping members or springs, or by other devices or mechanisms designed to create or otherwise dampen an oscillation force to a desired range or frequency.

Figure 5:
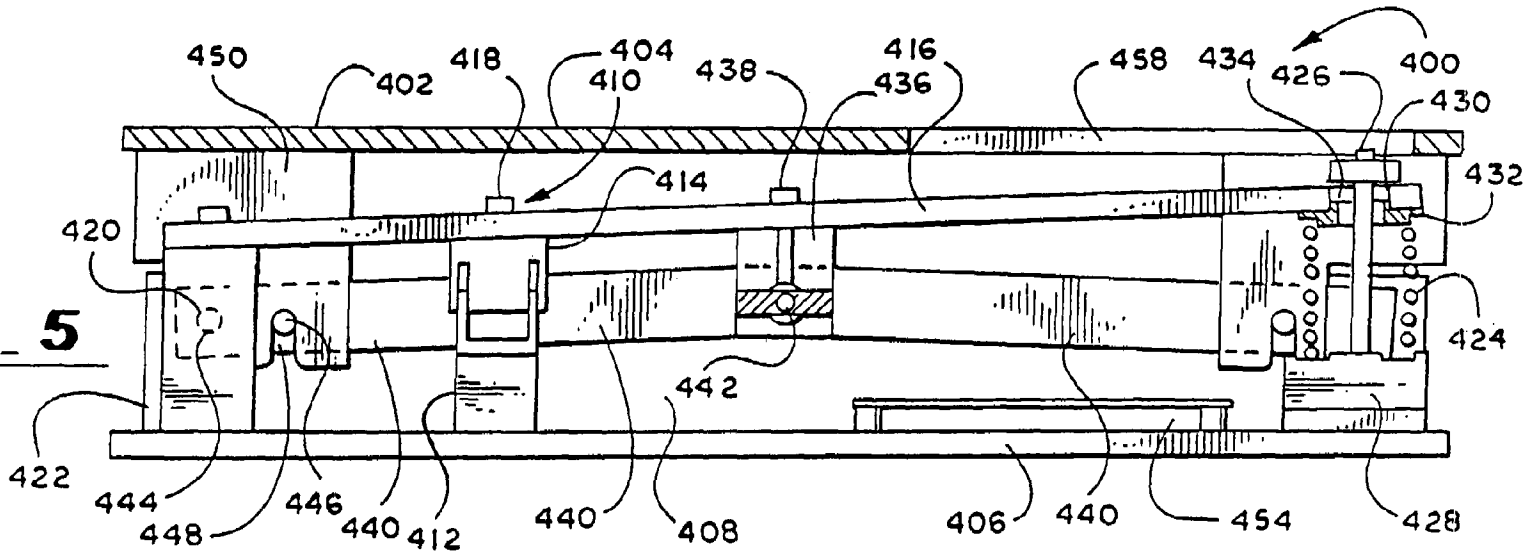
FIG. 5 is a side sectional view along line A—A in FIG. 4, showing the oscillating platform in an up-position.
Figure 6:
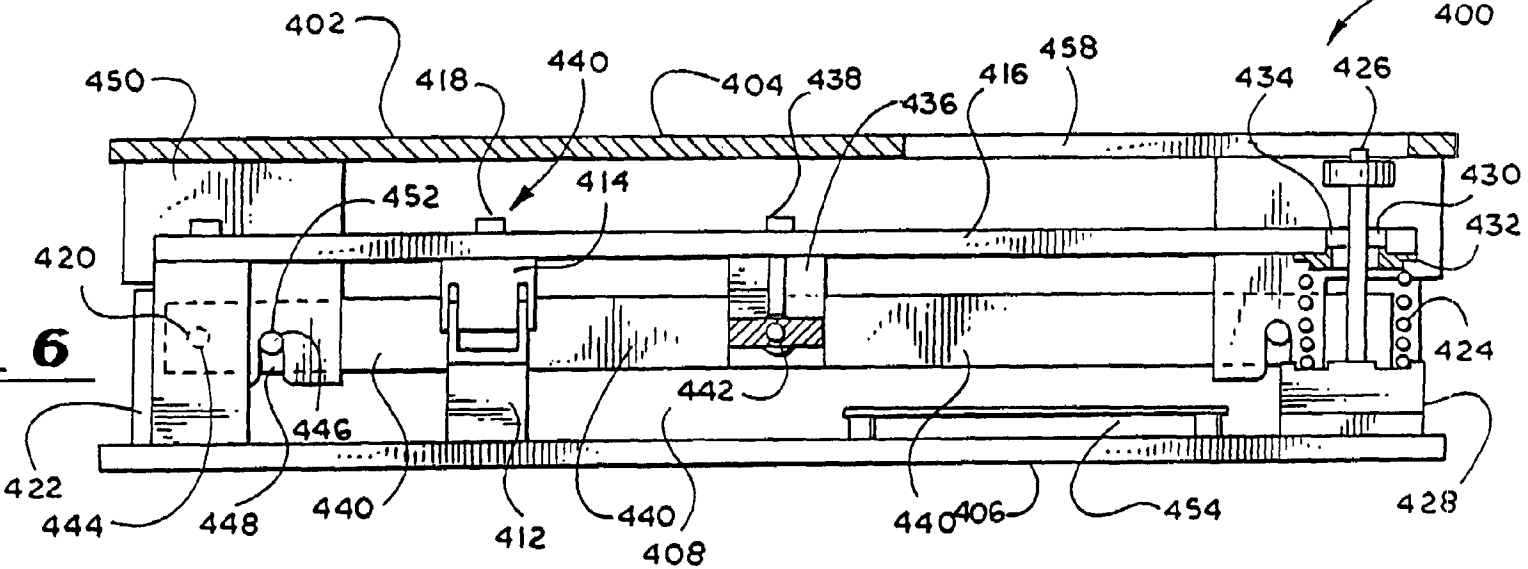
FIG. 6 is a side sectional view along line A—A in FIG. 4, showing the oscillating platform in a mid-position.
Figure 7:
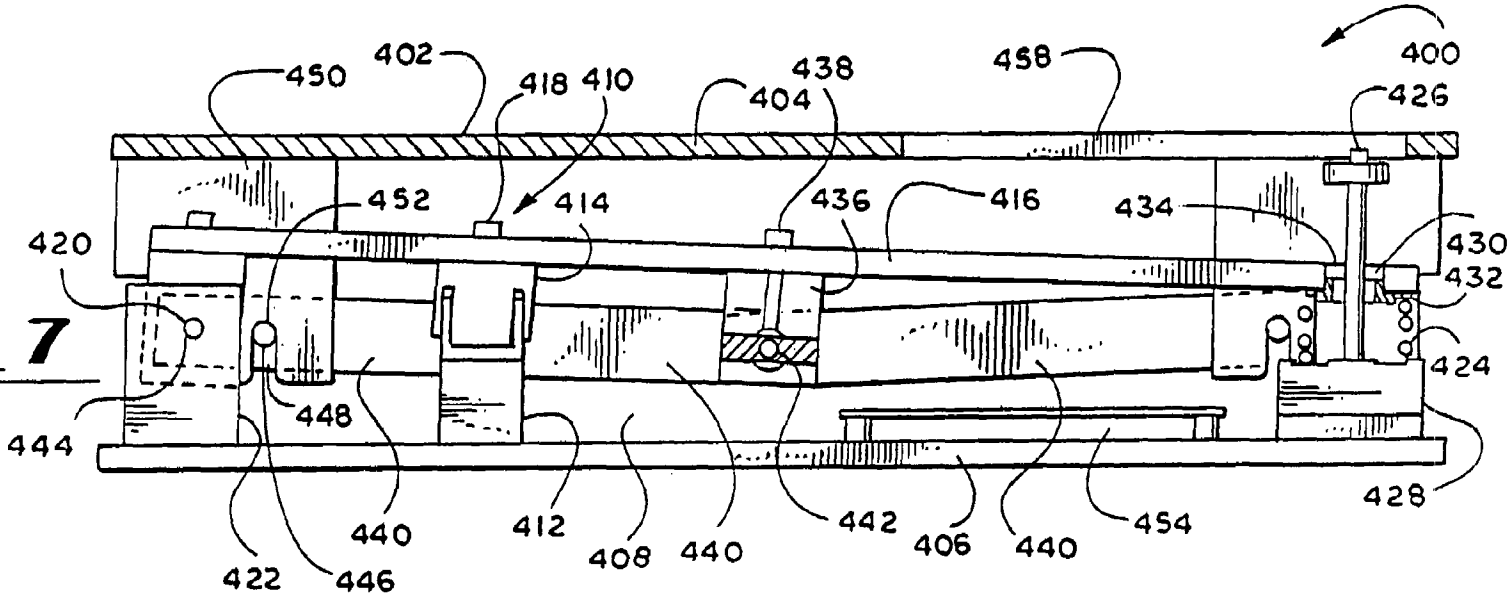
FIG. 7 is a side sectional view along line A—A in FIG. 4, showing the oscillating platform in a down-position.

FIGS. 5–7 illustrate the platform 400 of FIG. 4 in operation. FIG. 5 is a side sectional view along line A—A in FIG. 4, showing the platform 400 in an up-position. FIG. 6 is a side sectional view along line A—A in FIG. 4, showing the platform 400 in a mid-position. FIG. 7 is a side sectional view along line A—A in FIG. 4, showing the platform 400 in a down-position. In FIGS. 5–7, the internal mechanism of the platform 400 is shown in operation with respect to a load (not shown) placed on the upper plate 404. These views illustrate the relative positions of the drive lever 416, side distribution lever arms 440, and the spring 424 while various loads are placed on the upper plate 404.

As shown in FIGS. 5–7, when a specific load is placed on the upper plate 404, the side distributing lever arms 440 respond to the respective load on the upper plate 404. In all instances, the load creates a downward force on the upper plate 404 that is transferred from the supports 450 to a respective lift pin 446 and further transferred to the side distributing lever arms 440, the crossover bar 436, and then to the drive lever 416 and spring 424. For example, in FIG. 5, when a load weighing approximately fifty pounds (22.5 kilograms) is placed on the upper plate 404, a side distributing lever arm 440 nearest to and adjacent to the drive lever pivot point 420 is displaced upward towards the crossover bar 436, whereas the side distributing lever arm 440 nearest to and adjacent to the spring 424 is displaced downward from the crossover bar 436. The drive lever 416 is displaced generally upward from the drive lever pivot point 420 with the spring 424 in a relatively extended position.

In FIG. 6, when a load weighing approximately 140 pounds (63 kilograms) is placed on the upper plate 404, the side distributing lever arm 440 nearest to and adjacent to the drive lever pivot point 420 is displaced to a substantially parallel orientation with the front side distributing lever arm 440 nearest to and adjacent to the spring 424. The drive lever 416 is displaced generally horizontal from the drive lever pivot point 420 with the spring 424 in a relatively compressed position compared to FIG. 5.

Finally, in FIG. 7, when a relatively large load of approximately 300 pounds (135 kilograms) is placed on the upper plate 404, the side distributing lever arm 440 nearest to and adjacent to the drive lever pivot point 420 is displaced downward towards the crossover bar 436, whereas the side distributing lever arm 440 nearest to and adjacent to the spring 424 is displaced upward from the crossover bar 436. The drive lever 416 is displaced generally downward from the drive lever pivot point 420 with the spring 424 in a relatively compressed position compared to FIGS. 5 and 6.

Figure 8:
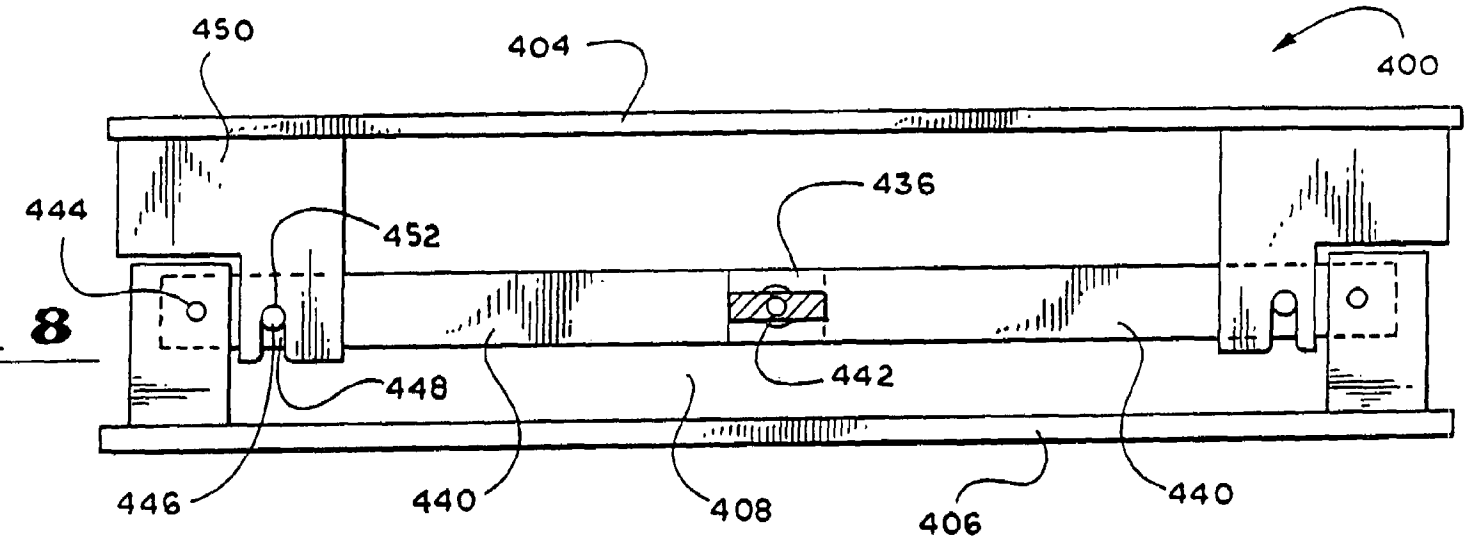
FIG. 8 is a side sectional view along line B—B in FIG. 4.

FIG. 8 is a side sectional view of the platform 400 along line B—B in FIG. 4. This view illustrates the platform 400 in a no-load position, and details the relative positions of the upper plate 404, side distribution lever arms 440, and crossover bar 436 in a no-load position.

Figure 9:
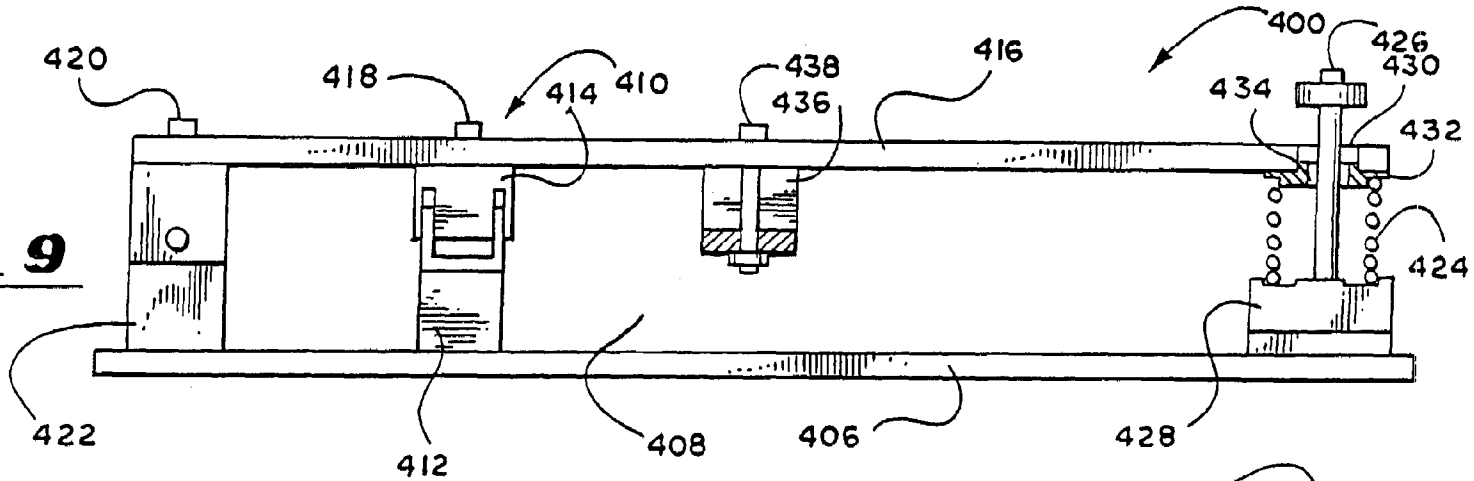
FIG. 9 is a side sectional view along line A—A in FIG. 4.

FIG. 9 is a side sectional view of the platform 400 along line A—A in FIG. 4. This view further illustrates the platform 400 in a no-load position, and details the relative positions of the drive lever 416, crossover bar 436, spring 424, and oscillating actuator 410 in a no load position.

Figure 10:
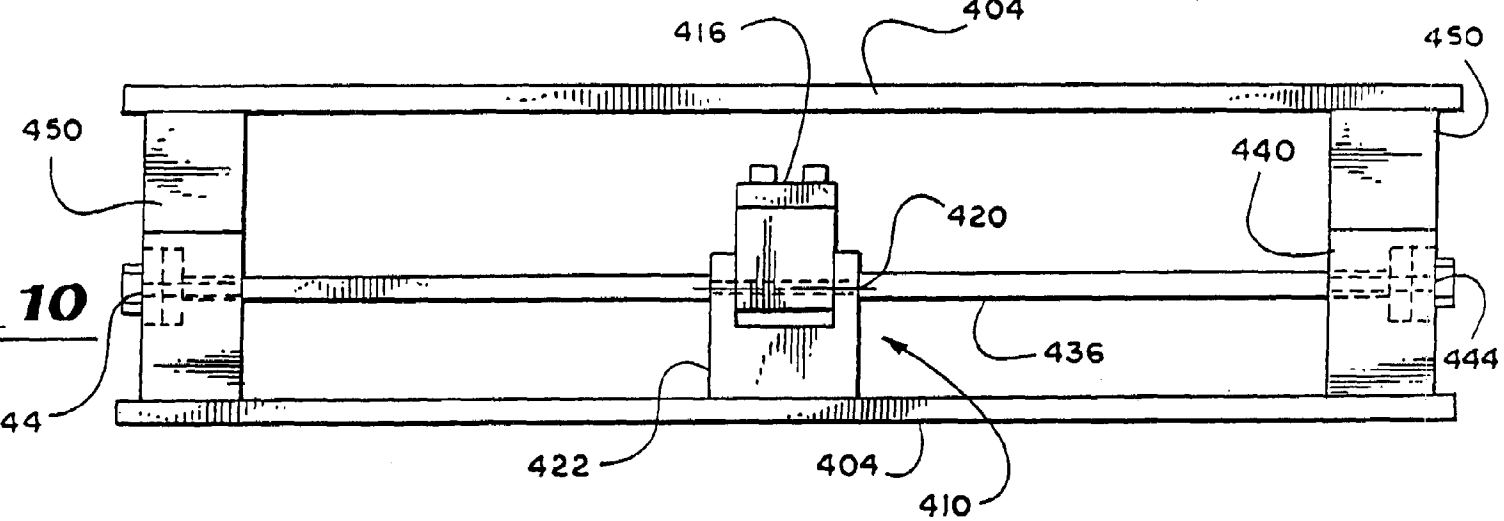
FIG. 10 is a rear section view along line C—C in FIG. 4, showing the oscillating platform.

FIG. 10 is a rear section view of the platform 400 along line C—C in FIG. 4, showing the platform 400 in a no-load position, and details the relative positions of the drive lever 416, oscillating actuator 410, crossover bar 436, side distribution lever arms 440, and upper plate 404.

Figure 11:
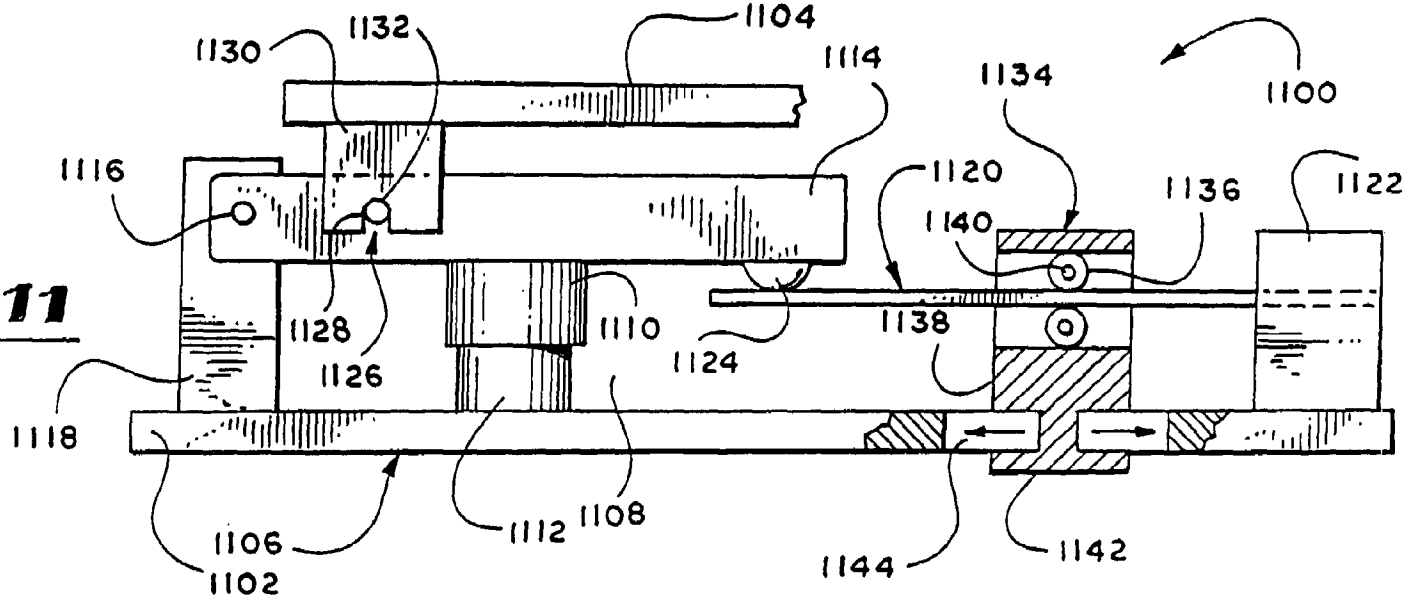
FIG. 11 is a side-sectional view of another oscillating platform according to various embodiments of the invention, showing the internal mechanism of the platform.

FIG. 11 illustrates another oscillating platform 1100 according to various embodiments of the invention. In FIG. 11, a cross-sectional view of the internal mechanism of an oscillating platform 1100. This embodiment is shown with a housing 1102 including an upper plate 1104, lower plate 1106, and side walls 1108. Note that the upper plate 1104 is generally rectangular or square-shaped, but can otherwise be geometrically configured for supporting a body in an upright position on top of the upper plate 1104, or in a position otherwise relative to the platform. Other configurations or structures can be also used to support a body in an upright position above, or otherwise relative to the platform. Oscillating actuator 1110 mounts to lower plate 1106 by oscillator mounting plate 1112, and connects to drive lever 1114 by one or more connectors (not shown).

Oscillating actuator 1110 causes drive lever 1114 to rotate a fixed distance at a first predetermined frequency around drive lever pivot point 1116 on drive lever mounting block 1118. The motion of the drive lever 1114 around the drive lever pivot point 1116 is damped by a damping member such as a cantilever spring 1120. The cantilever spring 1120 then creates an oscillation force at a second predetermined frequency, such as its resonance frequency or a harmonic or sub-harmonic of the resonance frequency. One end of the cantilever spring mounts to a spring mounting block 1122, while the other end of cantilever spring 1120 is in contact with the drive lever 1114 or spring contact point 1124. The spring contact point 1124 may be an extension piece mounted to the underside of the drive lever 1114 and configured for contact with the cantilever spring 1120.

One or more lift pins 1126 extend from a lateral side of the drive lever 1114. The lift pins 1126 engage a respective notch 1128 in one or more corresponding supports 1130 mounted to the underside of the upper plate 1104. The free-floating upper plate 1104 is supported by one or more contact points 1132 between the lift pins 1126 and the supports 1130.

The second predetermined frequency, such as the resonance frequency or a harmonic or sub-harmonic of the resonance frequency, of the cantilever spring 1120 can be adjusted by a node point 1134. The node point 1134 consists of a dual set of rollers 1136, a roller mounting block 1138, connectors 1140 and an external knob 1142. The cantilever spring 1120 mounts between the dual set of rollers 1136 so that the rollers 1136 can be positioned along the length of the cantilever spring 1120. The dual set of rollers 1136 mount to the roller mounting block 1138 via connectors 1140. The position of the roller mounting block 1138 can be adjusted along the length of the cantilever spring 1120 by an external knob 1142 that slides along a track 1144 parallel with the length of the cantilever spring 1120.

The position of the node point 1134 can be manually or automatically adjusted, or otherwise pre-set along the length of the cantilever spring 1120. When the node point 1134 is adjusted to a specific position along the cantilever spring 1120, the node point 1120 acts as a fixed point or fulcrum for the cantilever spring 1120 so that a resonant length of the cantilever spring 1120 can be set to a specific amount. Note that the resonant length of the cantilever spring 1120 depends upon the mass of the load placed on the upper plate 1104 and the mass of the combined drive lever 1114 and cantilever spring 1120. The end of the cantilever spring 1120 in contact with the drive lever 1114 or spring contact point 1124 can then resonate when the oscillating actuator 1110 is activated. For example, with a fixed mass placed on the upper plate 1104, as the node point 1134 is positioned towards the drive lever 1114 or spring contact point 1124, the resonant length of the cantilever spring 1120 becomes relatively lesser. Alternatively, as the node point 1134 is positioned towards the spring mounting block 1122, the resonant length of the cantilever spring 1120 becomes relatively greater.

Figure 12:
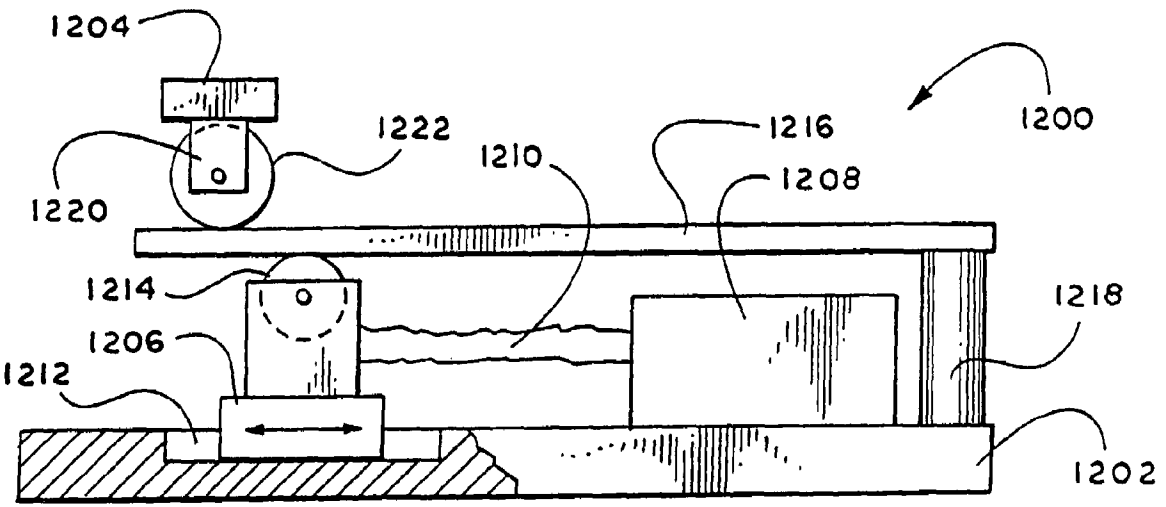
FIG. 12 is a side-sectional view of another oscillating platform according to various embodiments of the invention, showing the internal mechanism of the platform.

FIG. 12 is a side-sectional view of another oscillating platform 1200 according to various embodiments of the invention, showing the internal mechanism of the platform. The view of this embodiment details another configuration of the internal mechanism of the oscillating platform 1200 with a cantilever spring with a sliding node. Other configurations or structures can be also used to perform the disclosed functions of the oscillating platform.

Generally, a housing (not shown) houses the internal mechanism. The housing includes a lower plate 1202 or base. An upper plate (not shown) for supporting a body or a mass opposes the lower plate 1202. An oscillating actuator (not shown), such as those disclosed in previous embodiments, mounts to lower plate 1202, and contacts the drive lever 1204 in a manner similar to that shown in FIG. 11. Generally, the drive lever 1204 is positioned adjacent to the upper plate to transfer oscillation movement from the drive lever to the upper plate and then to a body supported by or in contact with the upper plate.

A node mounting block 1206 and an associated servo stepper motor 1208 mount to the lower plate 1202. The node mounting block 1206 and servo stepper motor 1208 connect to each other via a connector 1210. When adjusted, the node mounting block 1206 can move with respect to the lower plate 1202 via a slot 1212 machined in the lower plate 1202. The node mounting block 1206 includes a first roller 1214 mounted to and extending from the upper portion of the node mounting block 1206.

A damping member such as a cantilever spring 1216 mounts to the lower plate 1202 with a fixed mounting 1218. The cantilever spring 1216 extends from the fixed mounting 1218 towards the proximity of the node mounting block 1206. The first roller 1214 mounted to the node mounting block 1206 contacts a lower portion of the extended cantilever spring 1216. As the node mounting block 1206 is moved within the slot 1212, the first roller 1214 moves with respect to the cantilever spring 1216. Similar to the configuration shown in FIG. 11, this type of configuration is called a "sliding node." A sliding node-type configuration causes the damping member such as a cantilever spring 1216 to change its frequency response as the node mounting block 1206 changes its position with respect to the damping member such as the cantilever spring 1216.

As described above, the drive lever 1204 mounts to or contacts the lower portion of the upper plate. A roller mount 1220 extends from the lower portion of the drive lever 1204 towards the cantilever spring 1216. A second roller 1222 mounts to the roller mount 1220, and contacts an upper portion of the extended cantilever spring 1216.

In this configuration, the oscillating actuator (not shown) causes drive lever 1204 to rotate a fixed distance at a first predetermined frequency around a drive lever pivot point (not shown). The motion of the drive lever 1204 around the drive lever pivot point is damped by a damping member such as the cantilever spring 1216. The cantilever spring 1216 then creates an oscillation force at a second predetermined frequency, such as its resonance frequency or a harmonic or sub-harmonic of the resonance frequency.

The second predetermined frequency, such as the resonance frequency or a harmonic or sub-harmonic of the resonance frequency, of the cantilever spring 1216 can be adjusted as the position of the node mounting block 1206 is changed with respect the to the cantilever spring, i.e. sliding node configuration. The position of the node mounting block 1206 can be manually or automatically adjusted, or otherwise pre-set along the length of the damped member or cantilever spring 1216. Note that the resonant length of the damped member such as the cantilever spring 1216 depends upon the mass of the load placed on the upper plate and the mass of the combined drive lever 1204 and cantilever spring 1216. The end of the cantilever spring 1216 in contact with the drive lever 1204 or a spring contact point can then resonate when the oscillating actuator is activated.

In the embodiments of an oscillating platform shown in FIGS. 11 and 12, and in other structures in accordance with various embodiments of the invention, the platform (also referred to as an "oscillating platform" or "mechanical stress platform") may be configured to allow different users to selectively adjust the platform to compensate for different weights of each user. For example, in a physical rehabilitation environment, patients or users having different weights may want to utilize the same oscillating platform. Each patient or user could set-up the oscillating platform for an anticipated user weight on the upper plate so that the oscillating platform can apply an oscillation force of a desired resonance frequency or harmonic or sub-harmonic of the resonance frequency to the user when he or she sits or stands on the upper plate. An external knob may be provided on the oscillating platform to permit the user to selectively adjust the oscillating platform in accordance with the user's weight.

In some embodiments such as those shown in FIGS. 11 and 12, the external knob controls the position of the sliding node, effectively changing the resonant length of the damped member such as a cantilever spring. In other embodiments, the external knob would control the position of the oscillating actuator relative to the drive lever. This type of configuration would allow the user to adjust the "effective length" of the drive lever and increase or decrease the vertical displacement of the drive lever as needed. The "effective length" of the drive lever is the distance from the centerline of the oscillating actuator to the end of the drive lever nearest the damping member or spring. For example, a user may increase the "effective length" of the drive lever by positioning the oscillating actuator towards the drive lever pivot point so that the corresponding vertical displacement of the drive lever can be increased. Conversely, a user may decrease the "effective length" of the drive lever by positioning the oscillating actuator towards the damping member or spring so that the corresponding vertical displacement of the drive lever can be decreased.

Thus, by positioning the oscillating actuator to a predetermined position in accordance with the weight of the user, or by positioning the sliding node in accordance with the weight of the user, the oscillating platform can provide a therapeutic vibration within a specific resonance frequency, or harmonic or sub-harmonic of the resonance frequency, range that is optimal for stimulating tissue or bone growth for different users having a range of different weights.

In other embodiments of the invention, the oscillating actuator may be configured for a single position. For example, in a home environment, a single patient only may utilize the oscillating platform. To reduce the amount of time necessary to set-up and operate the oscillating platform, the oscillating actuator may have a pre-set position in accordance with the particular patient's weight. The patient can then utilize the oscillating platform without need for adjusting the position of the oscillating actuator.

Finally, the embodiments disclosed above can also be adapted with a "self-tuning" feature. For example, when a user steps onto an oscillating platform with a self-tuning feature, the user's mass may be first determined. Based upon the mass of the user, the oscillating platform automatically adjusts the various components of the oscillating platform so that the oscillating platform can apply an oscillation force of a desired resonance frequency or harmonic or sub-harmonic of the resonance frequency to the user when he or she sits or stands or is otherwise supported by the oscillating platform. In this manner, the oscillating platform can provide a therapeutic treatment in accordance with the various embodiments of the invention, without need for manually adjusting the oscillating platform according to the user's mass, and reducing the possibility of user error in adjusting or manually tuning the oscillating platform for the desired treatment frequency.

While the above description contains many specifics, these specifics should not be construed as limitations on the scope of the invention, but merely as exemplifications of the disclosed embodiments. Those skilled in the art will envision many other possible variations that within the scope of the invention as defined by the claims appended hereto.

What is claimed:

1. A method for therapeutically treating at least a portion of a body, comprising the steps of:

supporting at least a portion of a body with a platform, the platform comprising:

at least one plate;

a drive lever supported by the at least one plate;

a damping member in contact with the drive lever, the damping member including a cantilever spring;

actuating the platform at a first frequency;

oscillating the damping member to create a force with a second frequency; and distributing the force to at least a portion of the platform.

2. The method of claim 1, wherein the second frequency is in the range of about 30Hz to about 120 Hz.

3. The method of claim 1, wherein the second frequency is in the range of about 30 Hz to about 36 Hz.

4. The method of claim 1, wherein the step of actuating the platform comprises activating an oscillating actuator to create a vertical displacement of the driver lever.

5. The method of claim 4, wherein the oscillating actuator consists of at least one of the following: an electromagnetic transducer, a piezoelectric transducer, or an electromagnetic coil and armature.

6. The method of claim 1, further comprising the step of biasing the driver lever to compensate for the weight of the body.

7. The method of claim 1, further comprising the step of biasing a resonance length of the damping member.

8. The method of claim 1, wherein the cantilever spring has a spring constant of approximately 9 psi.

9. The method of claim 1, wherein at least a portion of the platform receives a frequency in the range of about 30 Hz to about 36 Hz.

10. A method for therapeutically treating at least a portion of a body, comprising the steps of:

supporting at least a portion of a body with a platform, the platform comprising:

at least one plate;

a drive lever supported by the at least one plate;

actuating at least a portion of the platform at a first frequency;

oscillating at least a portion of the platform to create a force on at least a portion of the body at a second frequency; and biasing the drive lever to compensate for at least a portion of the weight of the body.

11. The method of claim 10, wherein the second frequency is in the range of about 30 Hz to about 120 Hz.

12. The method of claim 10, wherein the second frequency is in the range of about 30 Hz to about 36 Hz.

13. The method of claim 10, wherein the platform further comprises a damping member, the damping member being in contact with the drive lever.

14. The method of claim 13, wherein the step of oscillating at least a portion of the platform is further defined by oscillating the damping member to create an oscillating force on the body at a second frequency.

15. An apparatus for therapeutically treating a portion of a body, the apparatus comprising:

a platform configured to support at least a portion of a body, the platform being configured to be actuated to oscillate in at least a partial vertical direction;

a drive lever supported from at least a portion of the platform;

an actuator configured to actuate the drive lever at a first frequency; and a damping member configured to create a force at a second frequency, the damping member including a cantilever spring.

16. The apparatus of claim 15, further comprising a drive lever mounting block mounted to a portion of the platform and configured to support at least a portion of the driver lever, and a drive lever pivot point, wherein the drive lever is configured to rotate about an axis with respect to the drive lever mounting block.

17. The apparatus of claim 15, wherein the platform further comprises an upper plate and a lower plate.

18. The apparatus of claim 15, wherein the second frequency is in the range of about 30 Hz to about 120 Hz.

19. The apparatus of claim 15, wherein the second frequency is in the range of about 30 Hz and to about 36 Hz.

20. The apparatus of claim 17, further including a printed circuit board, the printed circuit board being mounted to the lower plate and providing control circuitry for operating the actuator.

21. The apparatus of claim 15, further including a knob mounted on the platform, the knob permitting a user to selectively adjust the resonant length of the damping member.

* * * * *